US006122939A

United States Patent [19]

Lonati et al.

[11] Patent Number: 6,122,939

[45] Date of Patent: Sep. 26, 2000

[54] PROCESS AND APPARATUS FOR REDUCING THE LEAD-IN THREAD LENGTH IN CIRCULAR KNITTING MACHINES

[75] Inventors: Francesco Lonati; Ettore Lonati; Tiberio Lonati; Fausto Lonati, all of Brescia, Italy

[73] Assignees: Lonati S.p.A., Monza; Matec S.p.A., Scandicci, both of Italy

[21] Appl. No.: 09/265,871

[22] Filed: Mar. 11, 1999

[30] Foreign Application Priority Data

| | | | |
|---|---|---|---|
| Mar. 16, 1998 | [IT] | Italy | MI98A0529 |
| May 27, 1998 | [IT] | Italy | MI98A1179 |
| Jun. 3, 1998 | [IT] | Italy | MI98A1235 |

[51] Int. Cl.[7] ..... D04B 35/00

[52] U.S. Cl. ..... 66/145 R

[58] Field of Search ..... 66/8, 13, 17, 18, 66/34, 140 R, 143, 142, 144, 145 R, 145 S

[56] References Cited

U.S. PATENT DOCUMENTS

| | | | |
|---|---|---|---|
| 3,760,608 | 9/1973 | Lonati . | |
| 3,803,878 | 4/1974 | Lonati | 66/145 R |
| 5,186,027 | 2/1993 | Tenconi | 66/145 R |
| 5,943,883 | 8/1999 | Plath et al. | 66/145 R |

FOREIGN PATENT DOCUMENTS

| | | | |
|---|---|---|---|
| 464770 | 1/1992 | European Pat. Off. | 66/145 R |
| 281433 | 8/1990 | German Dem. Rep. | 66/145 R |
| 33 25 102 | 1/1985 | Germany . | |
| 195 11 949 | 10/1996 | Germany . | |

*Primary Examiner*—Danny Worrell
*Attorney, Agent, or Firm*—Guido Modiano; Albert Josif; Daniel O'Byrne

[57] ABSTRACT

A process and an apparatus for reducing the length of the lead-in thread in double-cylinder circular hosiery-making or knitting machines in which the thread, fed by a corresponding thread guide, is clamped at its end, before knitting begins, by a thread cutting and clamping device which laterally faces the needle cylinders of the machine downstream of the position of the thread guide, relative to the direction in which the needle cylinders rotate about their own axis, with respect to the thread guide and to the cutting and clamping device. The process consists in keeping the thread clamped by the cutting and clamping device even after the thread has been taken up by the needles at the beginning of the knitting process, and in cutting the portion of thread which, at the beginning of the knitting process, lies between the first needle that took up the thread and the point where the thread is clamped in the cutting and clamping device. The thread is cut by means of a lead-in cutting device adjacent to the first needle that took up the thread and therefore the lead-in is very short and requires no further cutting.

23 Claims, 14 Drawing Sheets

PROCESS AND APPARATUS FOR REDUCING THE LEAD-IN THREAD LENGTH IN CIRCULAR KNITTING MACHINES

BACKGROUND OF THE INVENTION

The present invention relates to a process and an apparatus for reducing the length of the lead-in thread in circular knitting machines, and in particular in double-cylinder circular hosiery-making or knitting machines.

It is known that in double-cylinder circular hosiery-making or knitting machines, at the end of the manufacturing process the thread or threads used to produce the knitted fabric are cut and retained by way of a suitable cutting and clamping device which laterally faces the needle cylinder. At the end of the manufacturing process, the thread accordingly runs from the corresponding thread guide that dispensed it to the cutting and clamping device that retains it after cutting it.

At the beginning of a new manufacturing process the thread guide is actuated so that its thread delivery end moves toward the needle work area and the cutting and clamping device is actuated so as to release the end of the thread which, as a consequence of the suction that is present in the needle cylinders, is drawn into the slot that divides the lower needle cylinder from the upper needle cylinder. The needles are then moved into the active position, at the feed or drop served by the thread guide, so as to engage the dispensed thread and form new loops of knitting.

Due to the fact that the end of the thread is released by the cutting and clamping device and is drawn into the needle cylinders before the thread is taken by the needles to form the loops of knitting, at the end of the knitting of the item said item has a lead-in thread which protrudes at the region that was knitted first.

This lead-in thread, which is not acceptable from an aesthetic point of view, must be cut with a manual operation in a subsequent finishing step which affects the overall production costs of the item.

SUMMARY OF THE INVENTION

The aim of the present invention is to solve the above problem by providing a process and an apparatus which can be applied to double-cylinder circular hosiery-making or knitting machines and allow to reduce the length of the lead-in thread so as to avoid the need for a subsequent manual operation for cutting said lead-in thread.

Within the scope of this aim, an object of the invention is to provide an apparatus which can be installed very simply in double-cylinder circular hosiery-making or knitting machines of a conventional type.

This aim, this object and others which will become apparent hereinafter are achieved by a process for reducing the length of the lead-in thread in double-cylinder circular hosiery-making or knitting machines in which the thread, fed by a corresponding thread guide, is clamped at its end, before knitting begins, by a thread cutting and clamping device which laterally faces the needle cylinders of the machine downstream of the position of said thread guide, relative to the direction in which the needle cylinders rotate about their own axis, with respect to said thread guide and to said cutting and clamping device, characterized in that it consists:

in moving the thread dispensing end of said thread guide toward the needle cylinders of the machine to allow the thread to be taken up by needles that are moved so as to knit at the feed served by said thread guide;

in keeping the end of the thread clamped by said thread cutting and clamping device while the needles that have been lifted to knit take up the thread;

in moving the cutting end of a lead-in cutting device toward the needle cylinders, said cutting device being arranged proximate to said thread cutting and clamping device, so as to engage said cutting end with the portion of thread that is arranged between said cutting and clamping device and the first one of the needles that has taken up the thread;

in cutting, by means of said cutting end of the lead-in cutting device, said portion of thread that is adjacent to the first needle that has taken up the thread.

In order to perform the process according to the invention, an apparatus is preferably used comprising: a thread guide, which laterally faces the needle cylinders and is adapted to dispense a thread to the needles at a feed or drop of the machine, and a thread cutting and clamping device which laterally faces the needle cylinders and is arranged downstream of said thread guide, along the direction in which the needle cylinders rotate, with respect to said thread guide and to said thread cutting and clamping device, characterized in that it comprises a lead-in cutting device which laterally faces the needle cylinders and is arranged proximate to said cutting and clamping device, said lead-in cutting device being provided with a cutting end which can engage the portion of thread that runs from said cutting and clamping device to the first one of the needles which, at the beginning of the knitting process, took up the thread dispensed by said thread guide during the rotation of the needle cylinders about their axis with respect to said thread guide.

BRIEF DESCRIPTION OF THE DRAWINGS

Further characteristics and advantages of the invention will become apparent from the following detailed description of two preferred but not exclusive embodiments of an apparatus for performing the process according to the invention, illustrated only by way of non-limitative example in the accompanying drawings, wherein:

FIG. 10 is a top plan view of the apparatus according to the invention, applied to a double-cylinder circular hosiery-making or knitting machine, with the needle cylinders shown in cross-section along a horizontal plane, in the inactive condition;

FIG. 11 is a top plan view of the apparatus according to the invention in a first operating condition;

FIG. 12 is a partially sectional lateral elevation view of the apparatus according to the invention, taken along a plane which is radial with respect to the needle cylinders, in the operating position that corresponds to the position shown in FIG. 11;

FIG. 13 is a view, similar to FIG. 12, of the apparatus according to the invention in another operating condition;

FIG. 14 is a view, similar to FIGS. 12 and 13, of the apparatus according to the invention in another operating condition.

DESCRIPTION OF THE PREFERRED EMBODIMENTS

Figure 1:
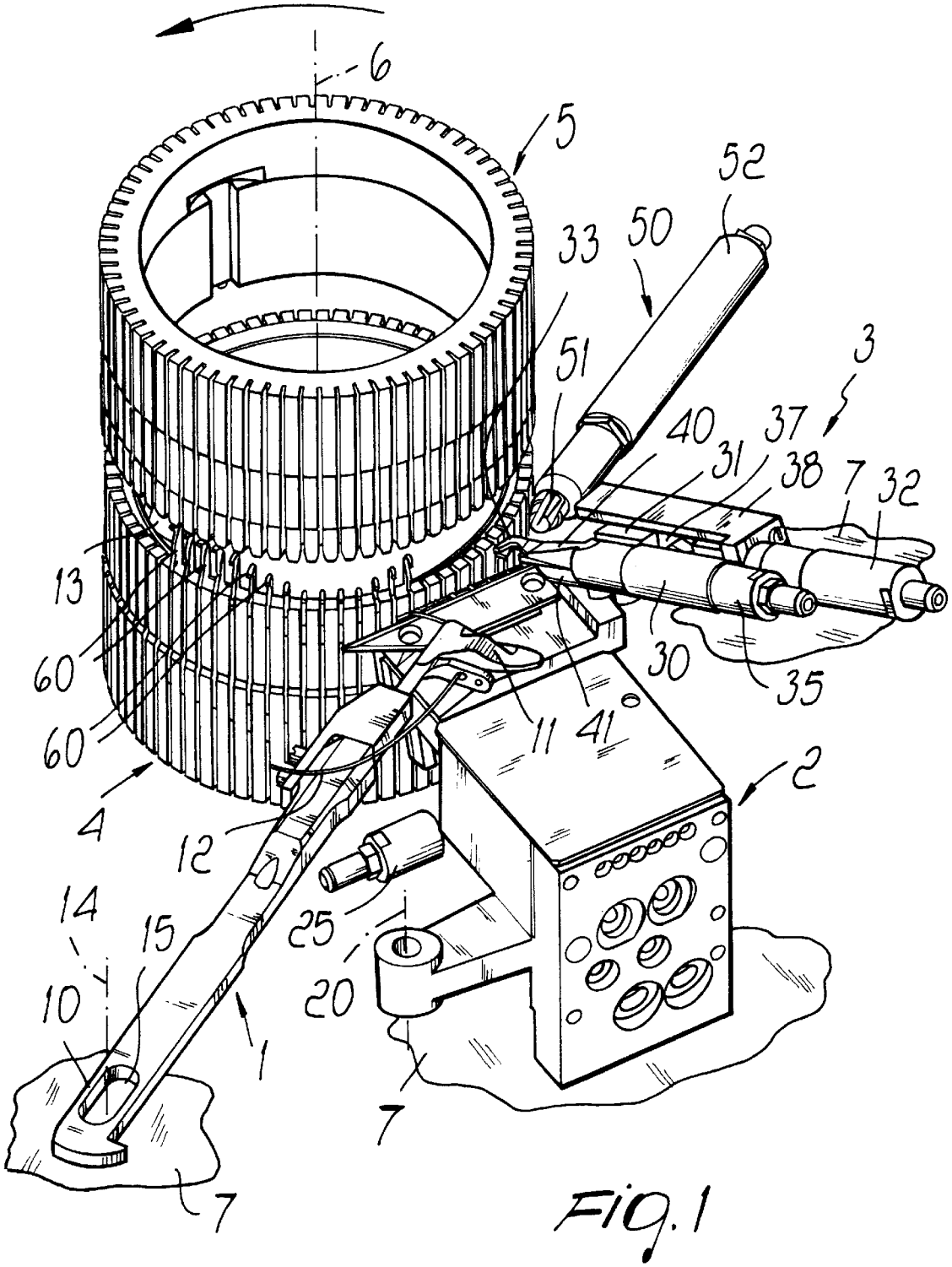
FIGS. 1 to 9 are schematic perspective views of the apparatus for performing the process according to the invention in a first embodiment, during the execution of the various steps of the process.

With reference to FIGS. 1 to 9, the apparatus for performing the process according to the invention, in its first embodiment, comprises: a thread guide 1, a cutting and clamping device 2, and a lead-in cutting device 3 which laterally face the needle cylinders 4 and 5, which can be actuated with a rotary motion about their axis 6 with respect to the supporting structure 7 of the machine that supports the thread guide 1, the cutting and clamping device 2 and the lead-in cutting device 3.

More particularly, the thread guide 1 can be constituted by a conventional thread guide which is supported by the supporting structure 7 of the machine at a longitudinal end 10 thereof and laterally faces, with its opposite end 11 which constitutes the end for dispensing the thread 12, the needle cylinders 4 and 5 at the needle work area, i.e., at the slot 13 that is formed between the lower needle cylinder 4 and the upper needle cylinder 5.

The body of the thread guide 1 is hinged, at its end 10, to the supporting structure 7 of the machine so that it can rotate, with respect to the supporting structure 7 of the machine, along an arc covering a preset angle about an axis 14 which is parallel to the axis 6 of the needle cylinders 4 and 5.

Moreover, the body of the thread guide 1 can preferably move in a direction which has a radial component with respect to the needle cylinders 4 and 5.

In practice, the body of the thread guide 1 is hinged to the supporting structure 7 of the machine by means of a pivot, not shown for the sake of simplicity, which passes through a slot 15 of the body of the thread guide 1; said slot is elongated in order to allow both a partial rotation of the body of the thread guide 1 about the axis 14 of the pivot and a translatory motion of the body of the thread guide 1 towards or away from the needle cylinders 4 and 5.

The partial rotation of the body of the thread guide 1 about the axis 14, as well as its translatory motion towards or away from the needle cylinders 4 and 5, can be achieved by means of conventional actuators, for example actuators of the mechanical or pneumatic type, or of the electromagnetic type, which are not shown for the sake of simplicity.

The cutting and clamping device 2 also can be constituted by a cutting and clamping device of a known type, which is associated with the supporting structure 7 of the machine so that it can be partially rotated about an axis 20 which is also parallel to the axis 6 of the needle cylinders 4 and 5.

More particularly, the cutting and clamping device 2 laterally faces, with one of its ends, the needle cylinders 4 and 5, proximate to the slot 13, downstream of the position occupied by the thread guide 1 during the dispensing of the thread 12. A cutting and clamping element 21 is arranged on this end of the device 2 and is constituted, in a per se known manner, by a hook which, at the end of the knitting process, engages the portion of thread that lies between the thread guide 1 and the last needle that took up the thread 12 dispensed by the thread guide 1 and makes it undergo the action of a blade and of a spring, both of which are arranged inside the device 2, so as to simultaneously cut and clamp the thread 12.

The rotation of the cutting and clamping device 2 about the axis 20 can be achieved, in a per se known manner, by means of an actuator of the pneumatic type 25, as shown, or by means of actuators of the mechanical or electromagnetic type, of a known kind, which are not illustrated for the sake of simplicity.

The lead-in cutting device 3 is arranged proximate to the cutting and clamping device 2 directly downstream of the thread clamping point in the device 2 in the direction in which the needle cylinders 4 and 5 rotate, and is supported by the supporting structure of the machine so that it can move in a direction which has a radial component with respect to the needle cylinders 4 and 5.

More particularly, the lead-in cutting device 3 comprises a body 30 which is mounted on a block 31 which is supported by the supporting structure 7 of the machine so that it can slide in a radial direction with respect to the needle cylinders 4 and 5. An actuator 32 acts on the block 31 and can be actuated to produce the translatory motion of the block 31 and therefore of the body 30 of the lead-in cutting device 3 toward or away from the needle cylinders 4 and 5.

The actuator 32 can be constituted by a pneumatic cylinder, as shown, or by an actuator of the mechanical or electromagnetic type or of another type.

More particularly, the block 31 is slidingly coupled to a guide 37 which is formed in a block 38 which is fixed to the supporting structure 7 of the machine. The guide 37 runs in a direction which has a radial component with respect to the needle cylinders 4 and 5. The actuator 32 is associated with the block 38 and acts on the block 31 with the stem of its piston to produce the translatory motion of the block 31 and therefore of the body 30 of the lead-in cutting device 3 in a direction which has a radial component with respect to the needle cylinders 4 and 5.

The body 30 of the lead-in cutting device has a cutting end 33 which is directed toward the needle cylinders 4 and 5 and is shaped like a hook which is open in the opposite direction with respect to the rotation of the needle cylinders, so as to engage the thread 12, as will become apparent hereinafter.

In the cutting end 33 there is a passage for a blade 34 which is actuated in a substantially radial direction with respect to the needle cylinders 4 and 5 relative to the body 30 by means of an actuator 35, for example a pneumatic cylinder, in order to cut the thread 12 engaged with the cutting end 33.

The actuator 35, instead of being constituted by an actuator of the pneumatic type, can also be constituted by an actuator of the mechanical or electromagnetic type or of another type.

The passage for the blade 34, in the cutting end 33, is preferably delimited in an upward region by a rigid plate 40 which acts as contrast blade and in a downward region by a flexible spring 41 which is meant to clamp the thread when it is cut by the blade 34.

It should be noted that the rotation of the cutting and clamping device 2 about the axis 20 moves the cutting and clamping element 21 towards or away from the cutting end 33 of the lead-in cutting device 3 and toward or away from the needle cylinders 4 and 5, as will become apparent hereinafter.

The apparatus according to the invention further preferably comprises an engagement device 50 which is supported by the supporting structure 7 of the machine. Said engagement device 50 has a hook-shaped end 51 which is arranged proximate to the cutting end 33 of the lead-in cutting device 3. The end 51 can move on command, in a substantially tangent direction with respect to the needle cylinders 4 and 5, between the cutting and clamping device 2 and the cutting end 33 of the lead-in cutting device 3, in order to engage the portion of the thread 12 that is arranged between the first needle that took up the thread 12 and the cutting and clamping device 2, upstream of the cutting end 33 of the lead-in cutting device 3 in the direction in which the needle cylinders 4 and 5 rotate, in order to tension it by carrying it downstream of said cutting end, causing its assured engagement with said cutting end 33 regardless of the position of the point where the thread 12 engages in the cutting and clamping device 2.

It should be noted that the engagement of the portion of thread 12 with the cutting end 33 of the lead-in cutting device 3 might still occur, albeit less precisely, simply as a consequence of the movement of said portion of thread 12 toward the cutting end 33 caused by the rotation of the needle cylinders 4 and 5 about their axis 5.

More particularly, the engagement device 50 comprises a fluid-driven cylinder 52 which is associated, by means of its body, with the supporting structure 7 of the machine and is orientated so that its axis is substantially tangent to the needle cylinders 4 and 5.

The hook-like end 51 is fixed to the end of the stem of the piston of the fluid-driven cylinder 52. Preferably, the fluid-driven cylinder 52 is of the single-acting type and the movement of the hook-like end 51 in the opposite direction with respect to the rotation of the needle cylinder is produced by feeding the cylinder 52 with a pressurized fluid, while movement in the opposite direction is achieved by means of a return spring, not shown for the sake of simplicity, and by connecting the cylinder 52 to the discharge.

The operation of the apparatus in the embodiment illustrated in FIGS. 1 to 9 in the execution of the process according to the invention is as follows.

At the end of a knitting process or in any case before beginning a knitting process, the thread 12 dispensed by the thread guide 1 at a drop or feed of the machine is clamped by the cutting and clamping device 2 and its end portion runs from the end 11 of the thread guide 1, which is spaced from the needle cylinders 4 and 5 toward the device 2, to the cutting and clamping element 21 of said device 2, as shown in FIG. 1.

Conveniently, some needles 60 of the needle cylinders 4 and 5 which directly precede the first needle 70 that is meant to take up the thread 12 at the feed or drop served by the thread guide 1 are moved, by means of a conventional needle selection device with which double-cylinder circular machines are usually equipped, into a position in which an intermediate portion of their extension lies at the slot 13.

In practice, the needles 60 are placed so that their upper tip is in the upper needle cylinder 5 and their lower tip is in the lower needle cylinder 4.

In this manner, the needles 60 form a barrier at the slot 13.

Figure 2:
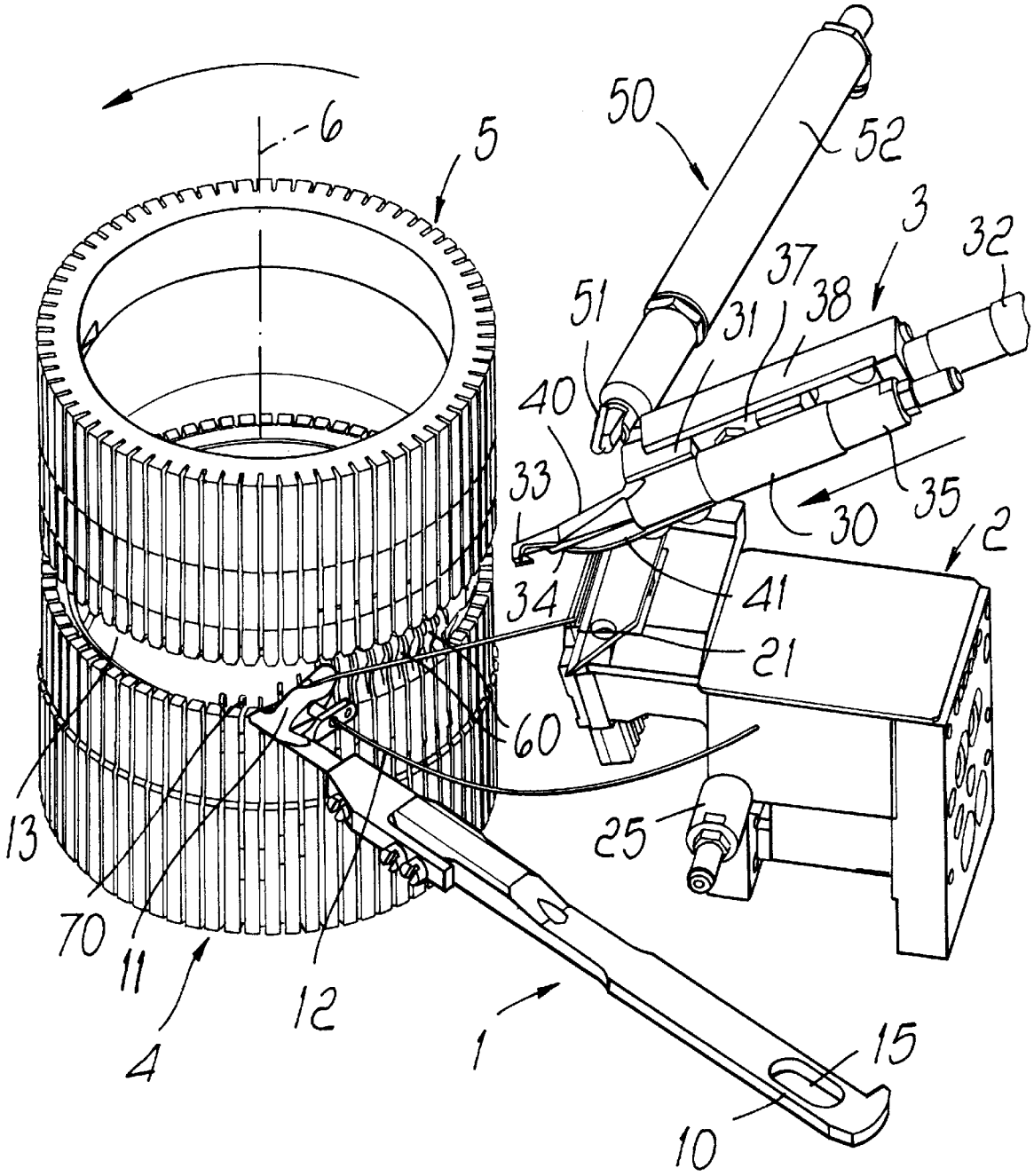

The thread guide 1 is then arranged, by rotation about the axis 14 and translatory motion toward the needle cylinders 4 and 5, so that its end 11 lies at the slot 13, so that the needles 70, in the lower needle cylinder 4, that are moved so as to knit at the feed served by the thread guide 1 can engage the portion of thread 12 that runs from the end 11 of the thread guide 1 to the cutting and clamping element 21 of the cutting and clamping device 2, which differently from conventional methods keeps the thread 12 clamped (FIG. 2).

It should be noted that the needles 60, which precede the needles 70 that must take up the thread at the feed or drop served by the thread guide 1, cannot engage the thread 12 and at the same time form a barrier which prevents the thread 12 from being drawn toward the inside of the needle cylinders 4 and 5.

The actuator 32 is simultaneously actuated and moves the cutting end 33 of the lead-in cutting device 3 toward the needle cylinders 4 and 5.

The portion of the thread 12 that runs from the end 11 of the thread guide 1 to the cutting and clamping element 21 of the device 2 is tensioned as a consequence of the movement imparted to the thread guide 1 with respect to the cutting and clamping device 2.

The needles 70, which are moved so as to knit at the feed served by the thread guide 1, thus assuredly engage said portion of thread and, as a consequence of the rotary motion of the needle cylinders 4 and 5 about the axis 6, move gradually toward the cutting and clamping device 2 which is located downstream of the thread guide 1 in the direction in which the needle cylinders 4 and 5 rotate with respect to the supporting structure 7 of the machine.

Figure 3:
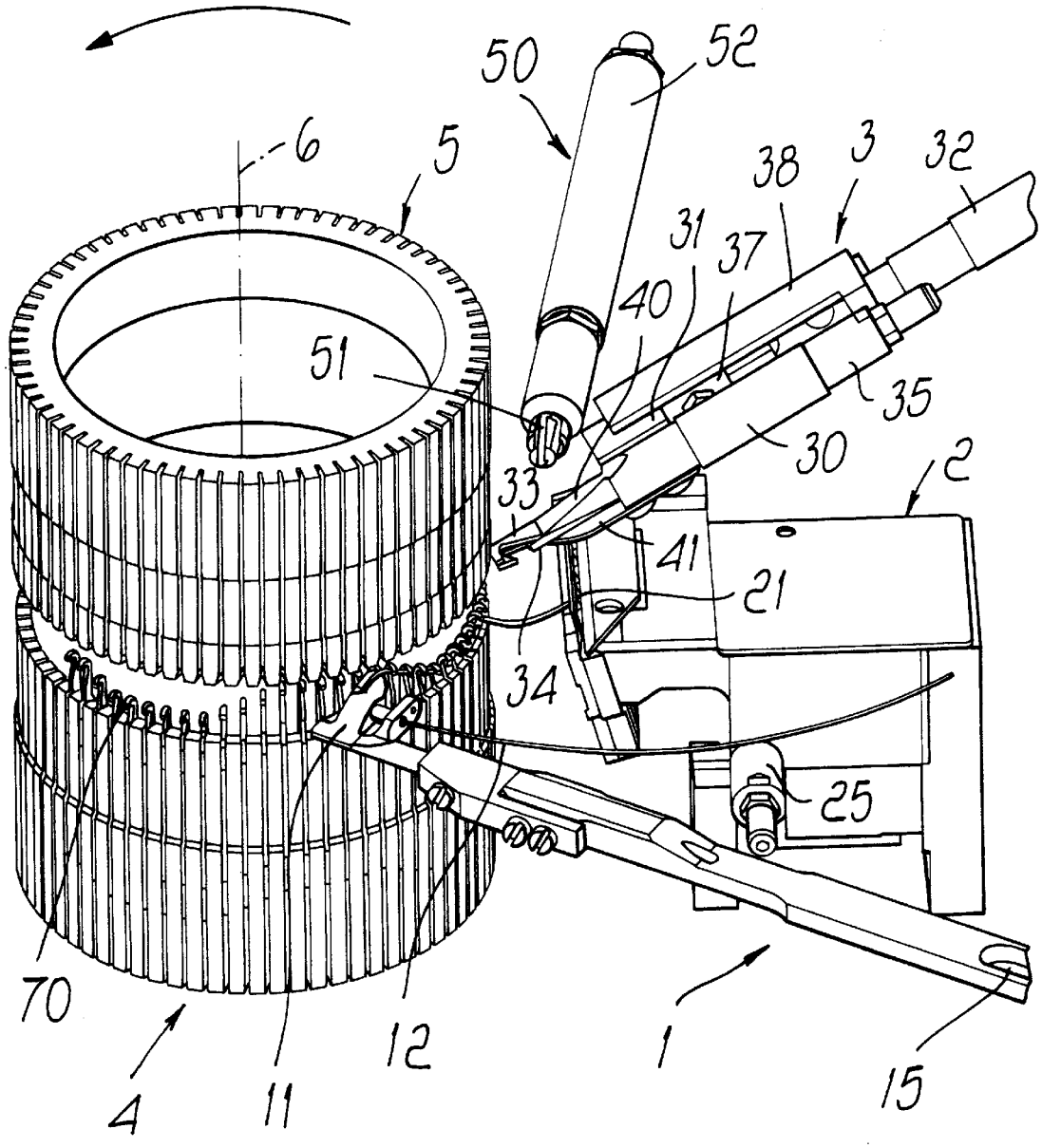

This approach slackens the portion of thread 12 that runs from the first needle 70 that engaged the thread to the cutting and clamping element 21 of the device 2 (FIG. 3).

Figure 4:
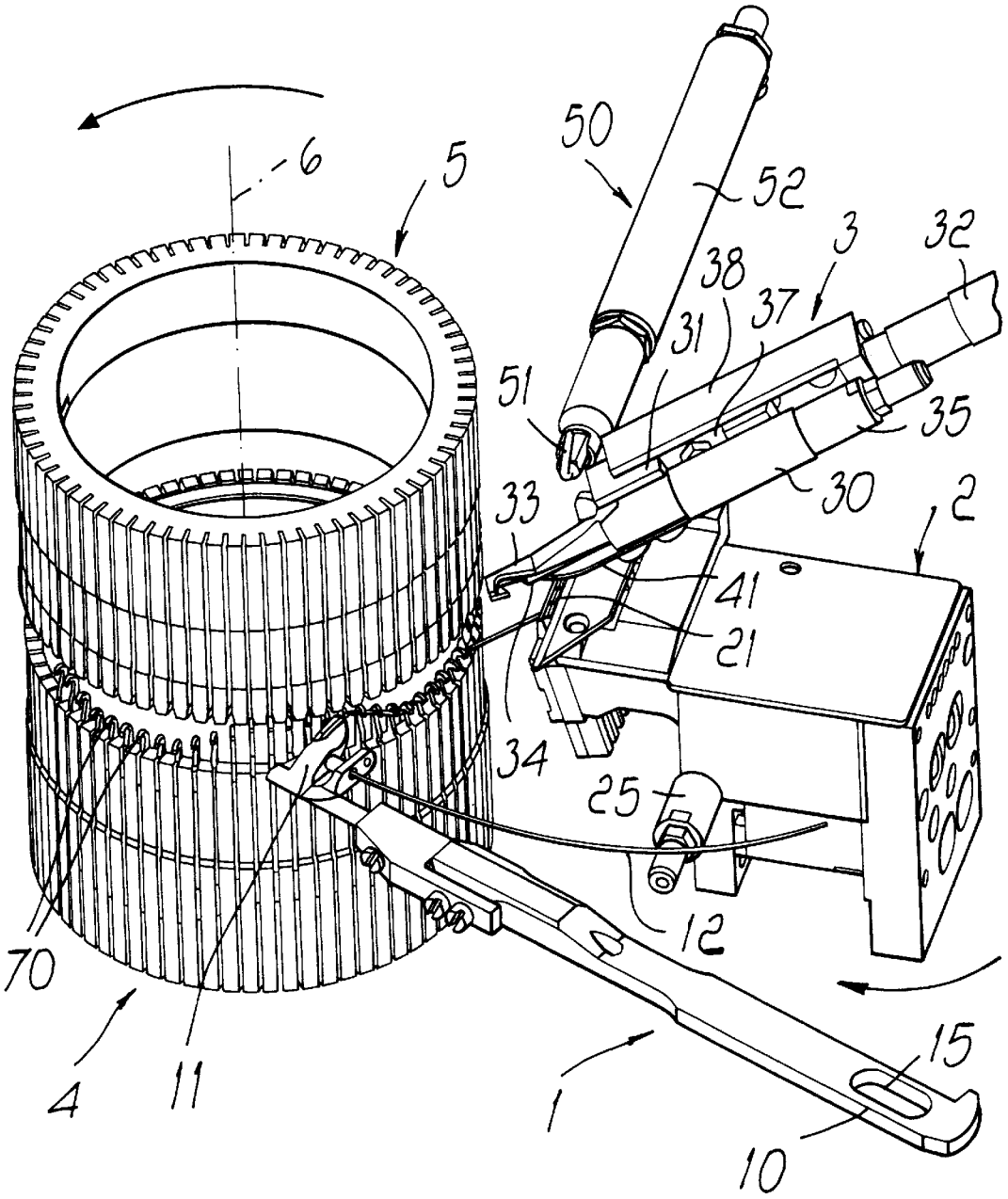

The actuator 25 is subsequently actuated, causing a rotation of the cutting and clamping device 2 about the axis 20 along an arc which covers a preset angle, so as to move the cutting and clamping element 21 toward the cutting end 33 of the lead-in cutting device 3 and move said cutting and clamping element 21 away from the needle cylinders 4 and 5 (FIG. 4). As a consequence of this fact, the portion of thread 12 that lies between the cutting and clamping element 21 of the device 2 and the first needle 70 that took up the thread is tensioned.

Figure 5:
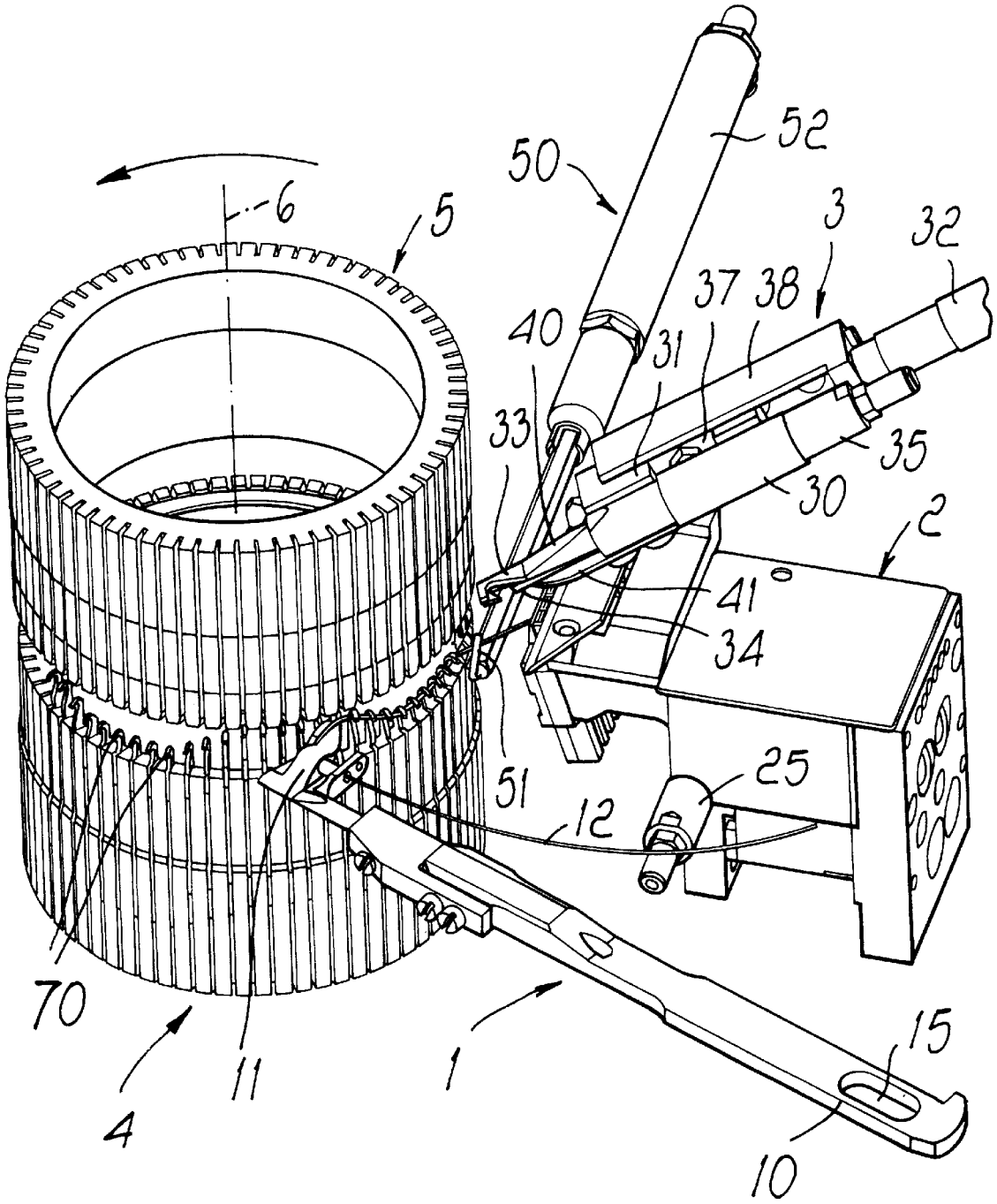
Figure 6:
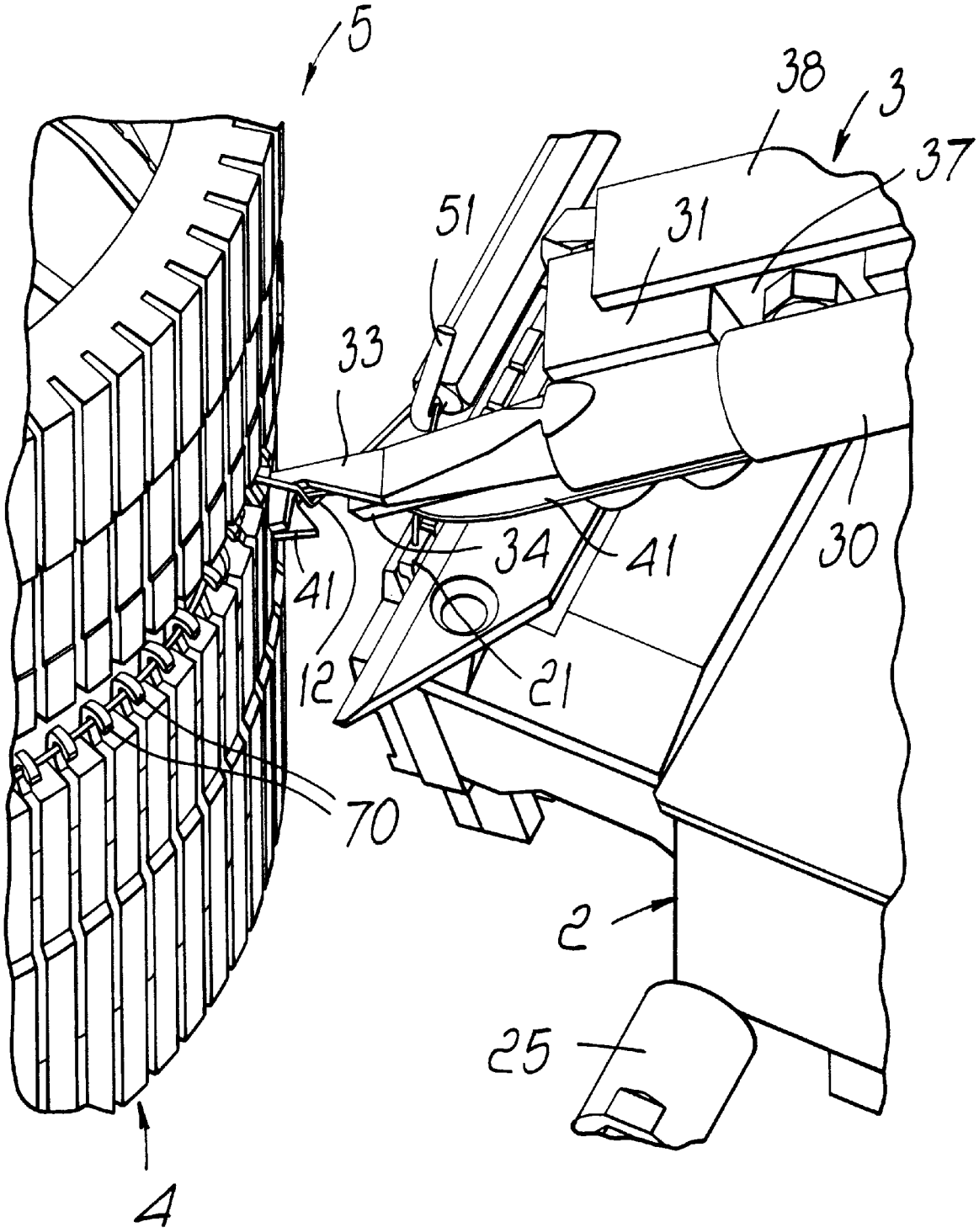

Also as a consequence of the rotation of the needle cylinders 4 and 5 about the axis 6, the first needle 70 that took up the thread 12 moves gradually toward the cutting end 33 of the lead-in cutting device 3, which is located proximate to the cutting and clamping device 2. At this point the fluid-driven cylinder 52 is actuated, moving the hook-like end 51 downstream of the cutting end 33 of the lead-in cutting device 3 in a position which is adapted to engage the portion of thread 12 that lies between the first needle 70 that took up the thread and the cutting and clamping element 21 of the device 2 (FIG. 5). Then the fluid-driven cylinder 52 is connected to the discharge and its return spring causes the hook-like end 51 to return downstream of the cutting end 33 of the device 3. In this manner, the hook-like end 51 engages the portion of thread 12 and tensions it, moving it into the cutting end 33 of the lead-in cutting device 3 (FIG. 6).

It should be observed that when the needles 70 have ended their descent into the lower needle cylinder 4, the thread 12 between said needles is engaged in a per se known manner by the sinkers supported by the sinker ring arranged inside the upper end of the lower needle cylinder 4 and is tensioned against the stem of said needles 70, while the needles 70 are lifted again to engage a thread which is fed at a subsequent feed so as to form new loops. The sinkers have not been illustrated for the sake of simplicity.

Figure 7:
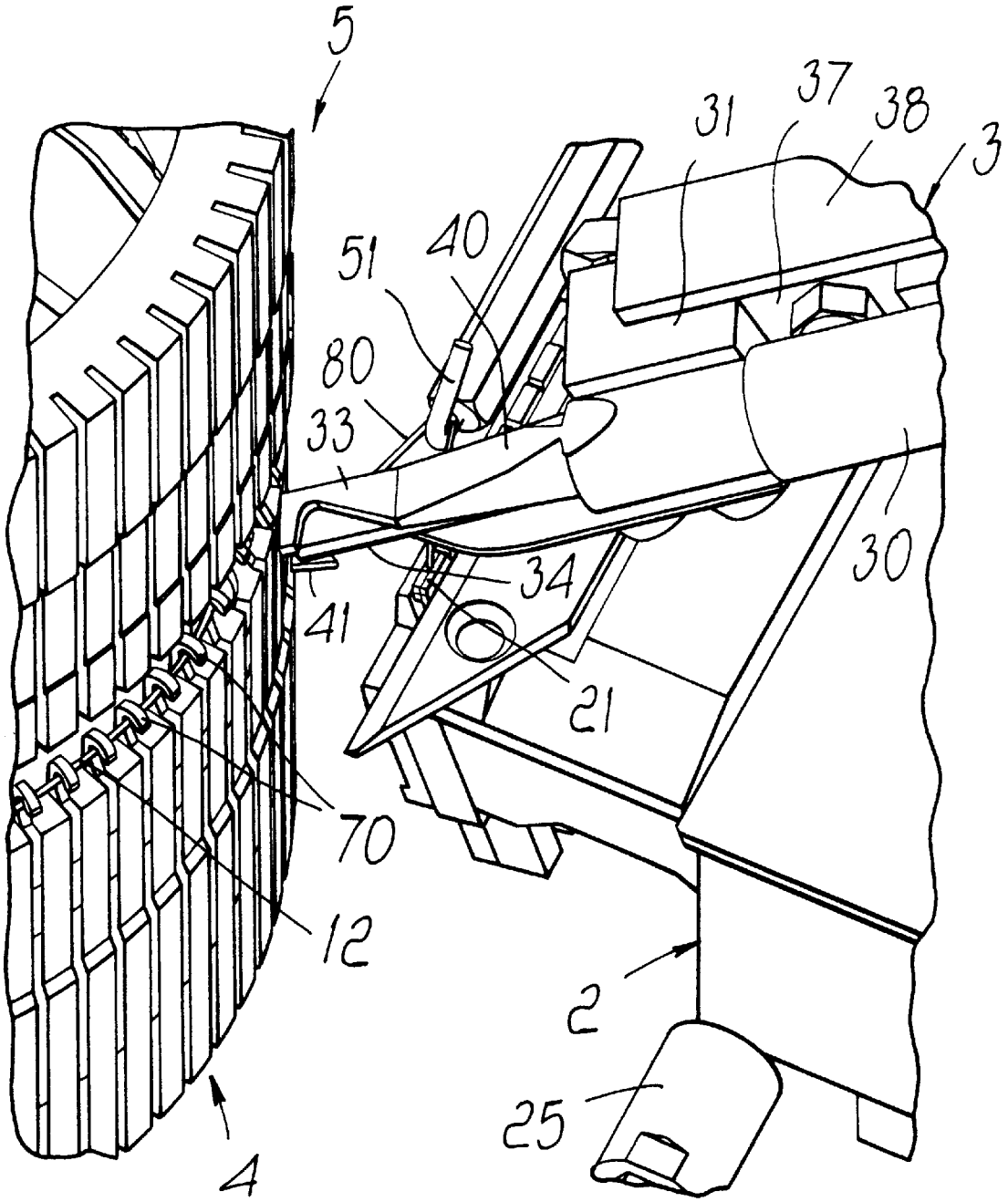

Then, while the portion of thread 12 is tensioned and engaged with the cutting end 33 of the device 3, the actuator 35 is activated, causing the blade 34 to slide in the cutting end 33 and therefore cutting the portion of thread 12 that lies between the first needle 70 that took it up and the cutting and clamping element 21 of the device 2 (FIG. 7).

If the engagement device 50 is not provided, and therefore if the engagement of the portion of thread 12 with the cutting end 33 of the lead-in cutting device 3 occurs only as a consequence of the rotation of the needle cylinders 4 and 5, after the portion of thread 12 has engaged the cutting end 33 the fluid-driven cylinder 25 is actuated again so as to produce a further rotation of the cutting and clamping device 2 which moves its thread clamping point toward the cutting end 33 and moves it away from the needle cylinders 4 and 5 to tension the portion of thread 12 before it is cut by the blade 34.

It should be observed that in any case the thread is cut adjacent to the first needle 70 that engaged it and remains clamped between the blade 34 and the spring 41. The cut lead-in thread, designated by the reference numeral 80, is thus clamped by the cutting and clamping element 21 of the device 2 at one of its ends and, at its other end, by the blade 34 and by the spring 41.

Figure 8:
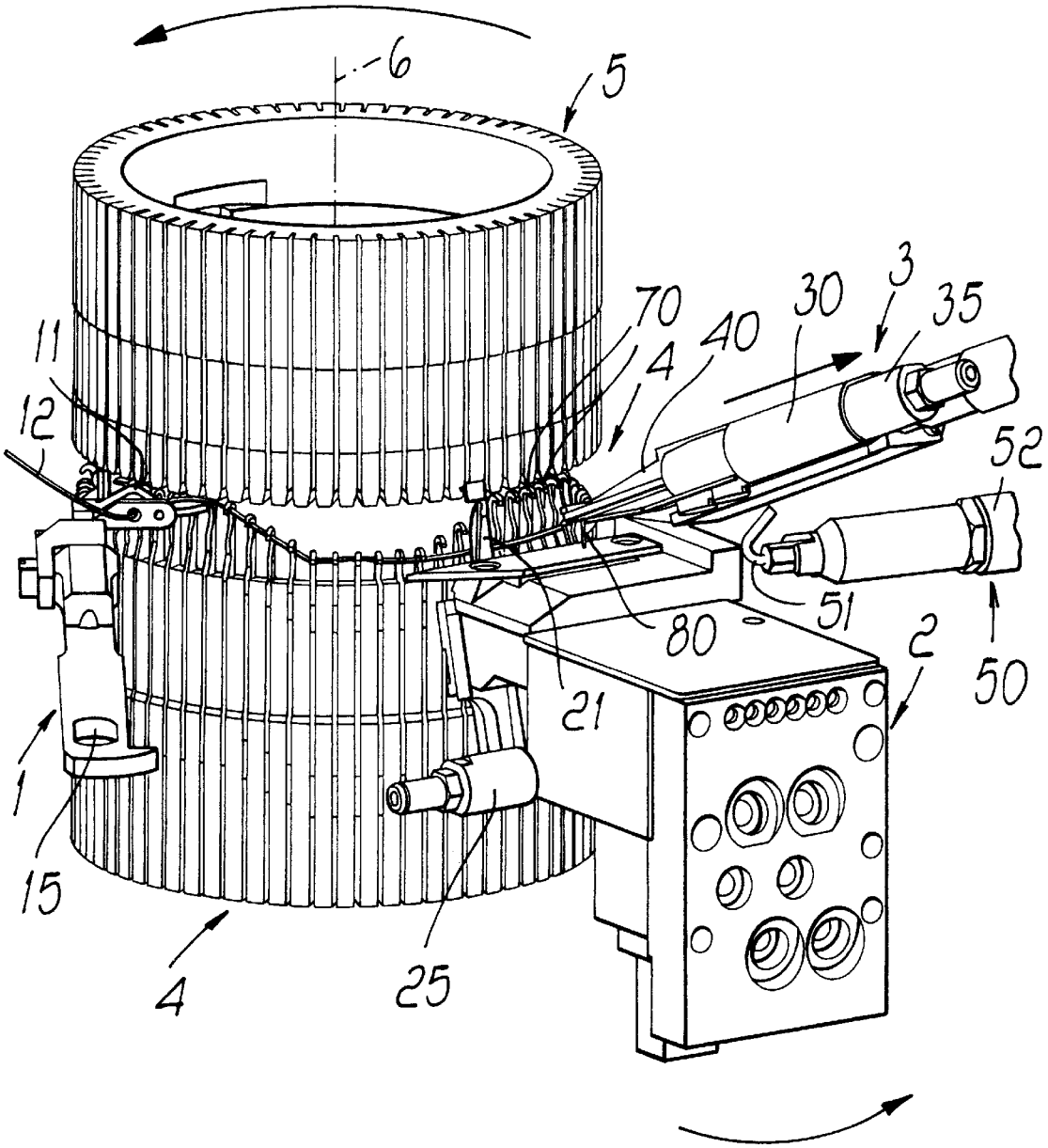

The actuators 25 and 32 are then actuated again, but in reverse with respect to the previous direction, so as to return the lead-in cutting device 3 and the cutting and clamping device 2 to the initial position, i.e., to the position shown in FIG. 1 (FIG. 8).

The cutting and clamping device 21 of the device 2 is also actuated and protrudes from the device 2, releasing the cut lead-in thread 80, and then retracts into the device 2.

Figure 9:
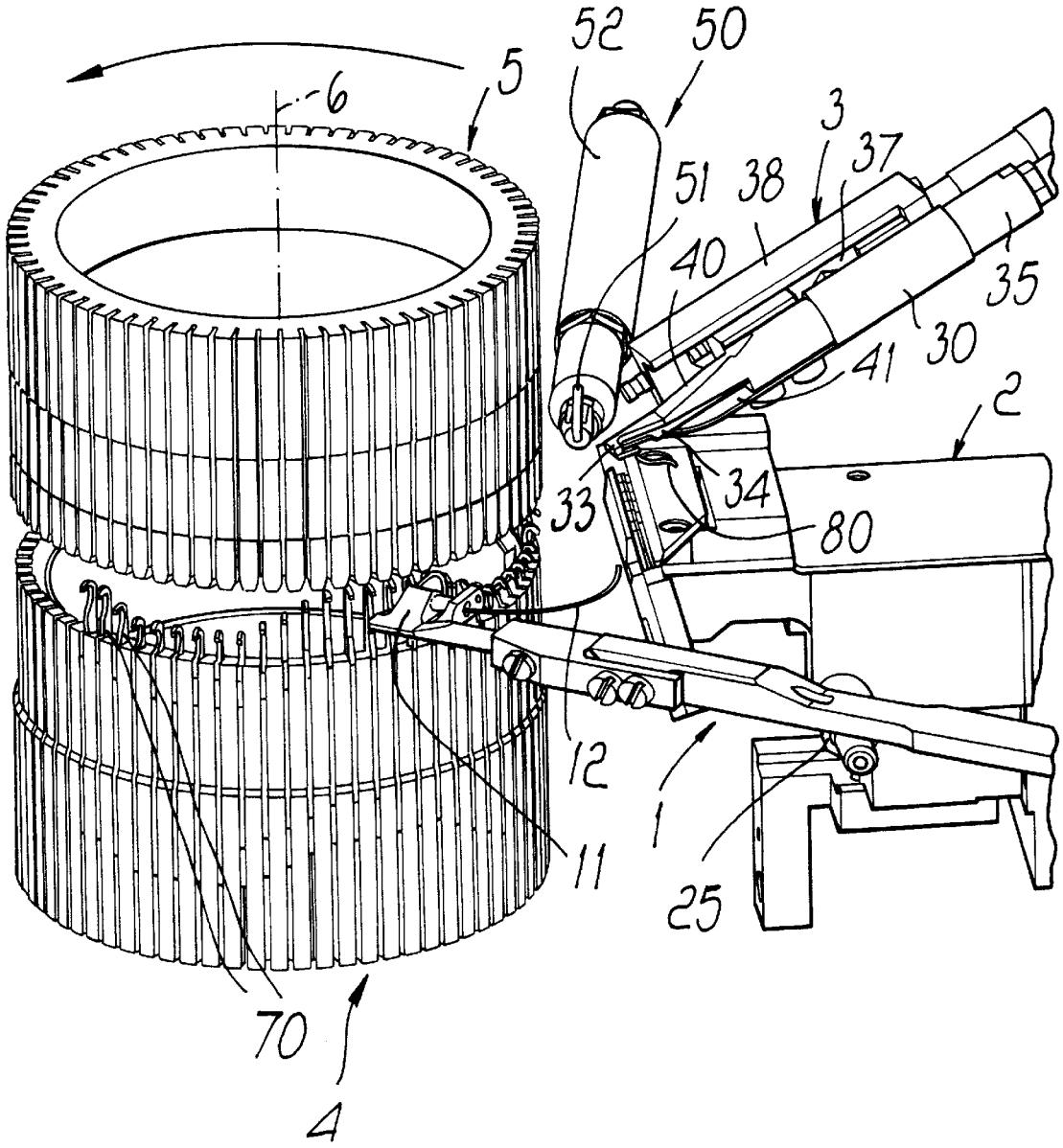

Finally, the actuator 35 is activated, causing the retraction of the blade 34 and thus releasing the other end of the cut lead-in thread 80 (FIG. 9).

With reference to FIGS. 10 to 14, the apparatus for performing the process according to the invention comprises, in its second embodiment, a thread guide 101 which laterally faces the needle cylinder 102 and 103 of a double-cylinder circular machine at a feed or drop of the machine, and a thread cutting and clamping device 104 which laterally faces the needle cylinders 102 and 103 and is arranged downstream of the thread guide 101 relative to the direction in which the needle cylinders 102 and 103 rotate about their axis 105 with respect to the thread guide 101 and the cutting and clamping device 104.

According to the invention, the apparatus further comprises a lead-in cutting device 106 which laterally faces the needle cylinders 102 and 103 and has a cutting end 107 which can be positioned between the point where the thread guide 101 dispenses the thread 110 and the point where the thread 110 is clamped in the cutting and clamping device 104. The cutting end 107 can be engaged by the thread portion 110*a* that lies between the cutting and clamping device 104 and the first needle 111 of the needle cylinders that engaged the thread 110 dispensed by the thread guide 101 in order to cut said portion of thread 110*a* adjacent to the first needle 111.

More particularly, the thread guide 101 can be constituted by a conventional thread guide, provided with a body 112 which is hinged to the supporting structure of the machine about an axis 113 which is parallel to the axis 105 of the needle cylinders. The body of the thread guide 112, besides being hinged to the supporting structure about the axis 113, can be movable, in a per se known manner, in a radial direction with respect to the needle cylinders 102 and 103.

Figure 10:
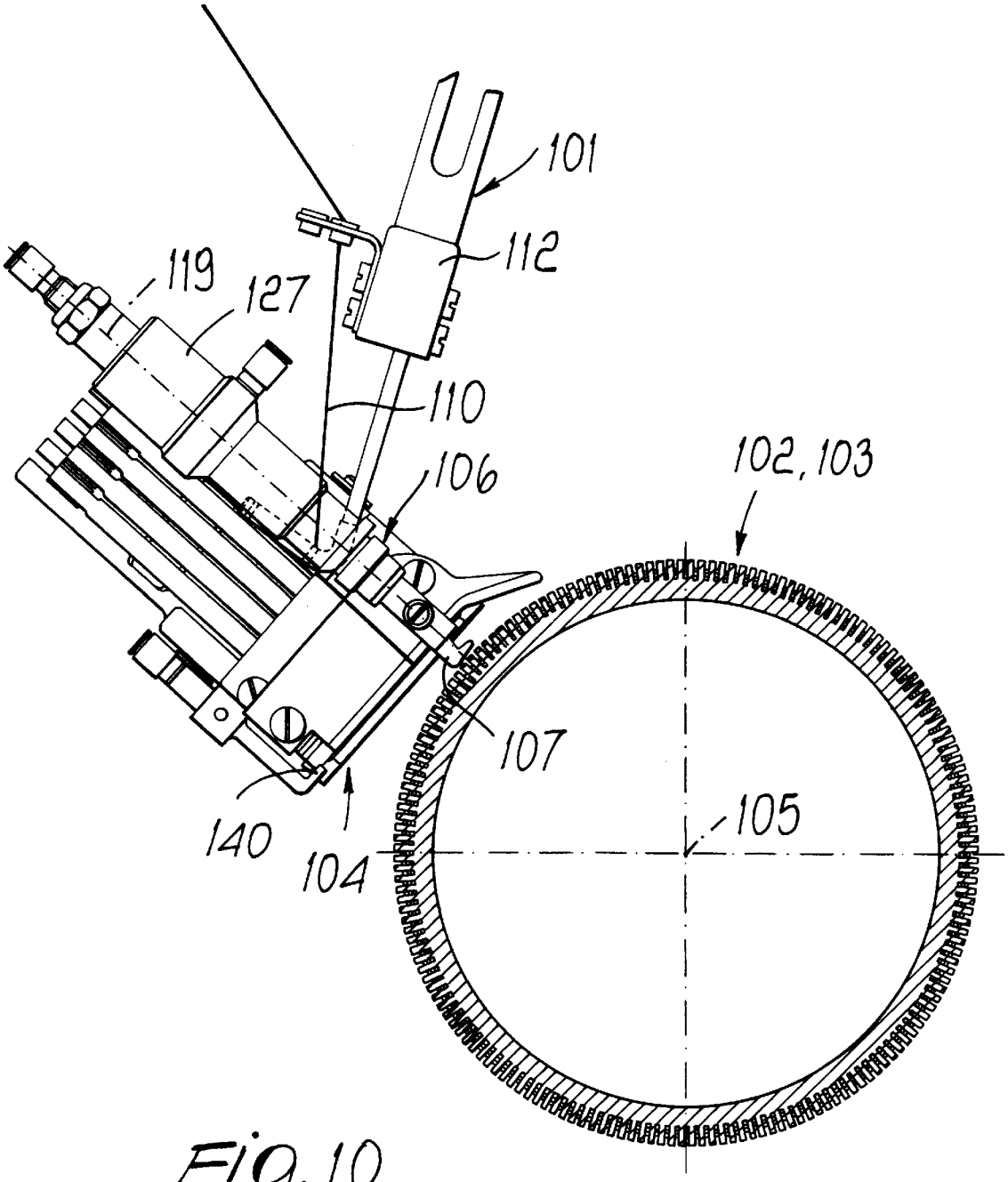
FIGS. 10 to 14 are views of the apparatus for performing the process according to the invention in a second embodiment, and more particularly.
Figure 11:
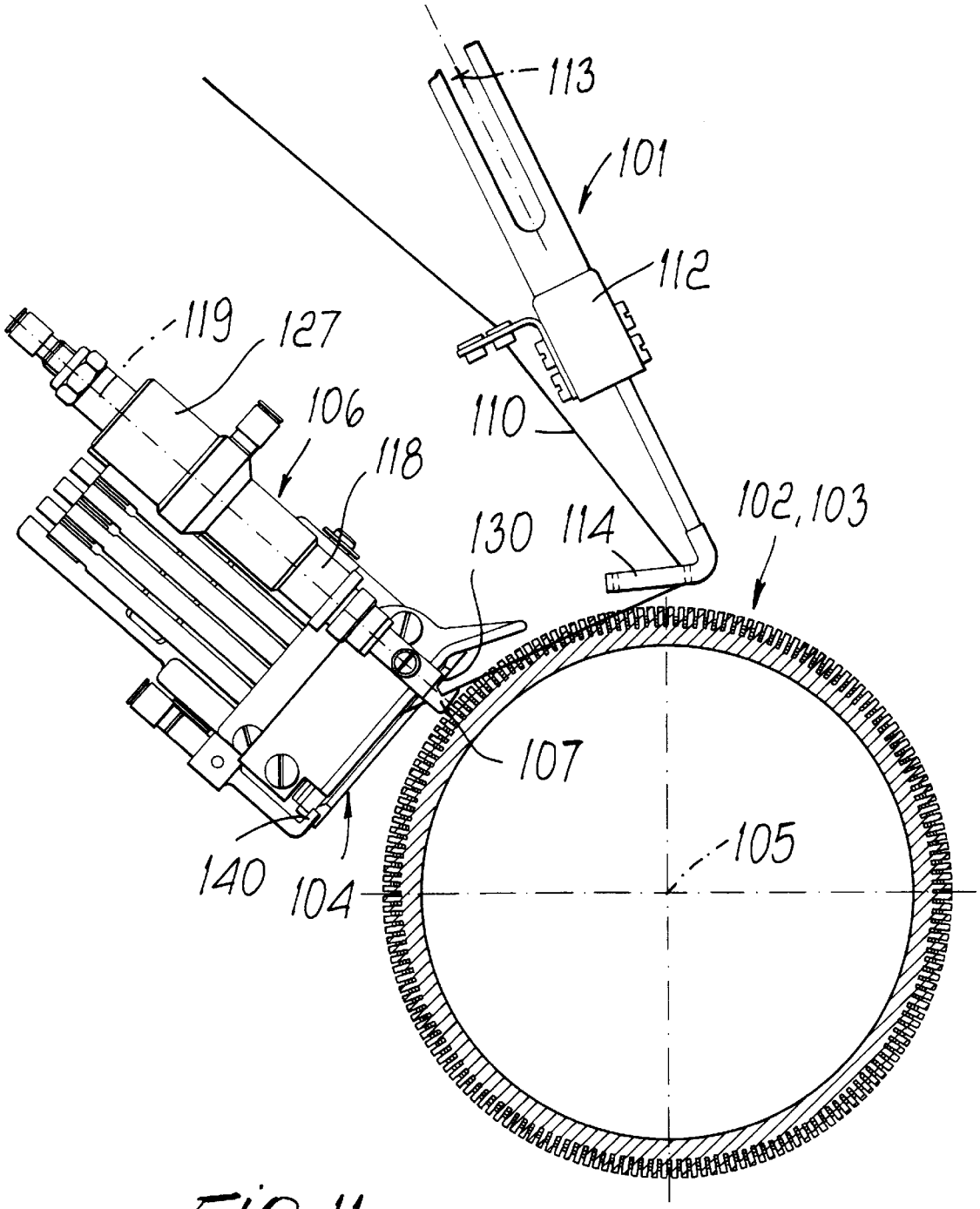

The connection provided between the thread guide 101 and the supporting structure of the machine allows to move the end 114 of the thread guide 101 from an inactive position, in which it is arranged proximate to the cutting and clamping device 104, as shown in FIG. 10, to an active position, in which it laterally faces the needle cylinders at the needle work area, i.e., at the slot 115 provided between the lower needle cylinder 102 and the upper needle cylinder 103 to allow the thread to be taken up by the needles 111 which are moved to knit at the feed being considered, as shown in FIG. 11.

The cutting and clamping device 104 can be constituted by a conventional cutting and clamping device provided with one or more cutting and clamping points for the thread 110.

The cutting and clamping device 104 is provided with one or more hooks 116 which, at the end of the knitting process, engage the portion of thread that lies between the thread guide 101 and the last needle that took up the thread 110 dispensed by the thread guide 101 and makes it undergo the action of a blade and of a spring, arranged inside the cutting and clamping device 104, so as to simultaneously cut and clamp the thread 110.

The cutting end 107 of the lead-in cutting device 106 can move on command towards or away from the needle cylinders 102 and 103.

Furthermore, said cutting end 107 of the lead-in cutting device 106 is preferably arranged directly upstream of the clamping point of the thread 110 in the cutting and clamping device 104 in order to achieve the engagement of the portion of thread 110*a* with said cutting end 107 as a consequence of the rotation of the needle cylinders 102 and 103 about their axis 105 with respect to the lead-in cutting device 106.

The cutting end 107 of the lead-in cutting device 106 is shaped like a hook which is open in the opposite direction with respect to the rotation of the needle cylinders 102 and 103 relative to the lead-in cutting device 106.

More particularly, the lead-in cutting device 106 comprises a fluid-driven cylinder 118 which is mounted, so that it can slide along its own axis 119, on a support 127 which is connected to the supporting structure of the machine. The axis 119 is arranged on a radial plane with respect to the needle cylinders 102 and 103 and is inclined with respect to a plane which is perpendicular to the axis 105 of the needle cylinders 102 and 103.

The piston 120 of the fluid-driven cylinder 118 is fixed, by means of its stem, to the cutting end 107, which during its movement along the axis 119 away from the needle cylinders 102 and 103 abuts against a cutting blade 130 which is rigidly coupled to the body of the fluid-driven cylinder 118, in order to cut the portion of thread 110*a* that is engaged by the cutting end 107. The body of the fluid-driven cylinder 118 can be provided, as shown, as the piston of an additional fluid-driven cylinder, whose body constitutes the support 127 and is fixed to the supporting structure of the machine. In practice, the support 127 constitutes the body of a second fluid-driven cylinder inside which there is a chamber 121 which slidingly accommodates the body of the fluid-driven cylinder 118 and can be fed with a pressurized fluid in order to move the fluid-driven cylinder or piston 118 along the axis 119 toward the needle cylinders 102, 103 in contrast with the action of a spring 123.

In the body of the fluid-driven cylinder 118 there is a chamber 124 which accommodates the piston 120 and can be supplied with a pressurized fluid in order to move the piston 120 along the axis 119, with respect to the body of the fluid-driven cylinder 118, toward the needle cylinders 102 and 103 in contrast with the action of a return spring 125.

Conveniently, there are means for moving away the portion of thread 110*a* cut by the lead-in cutting device 106 in order to prevent said portion of thread 110*a* from being knitted in. Said spacing means comprise a nozzle 140 for dispensing a jet of compressed air which can be actuated on command. The nozzle 140 is arranged proximate to the cutting and clamping device 104, downstream of the lead-in cutting device 106, and is orientated so as to be tangent to the needle cylinders 102, 103 toward the cutting end 107 of the lead-in cutting device 106.

The operation of the device in its second embodiment, in the execution of the process according to the invention, is as follows.

In the inactive condition, the thread guide 101 is positioned so that its end 114 for dispensing the thread 110 is close to the cutting and clamping device 104. In this inactive condition, the end of the thread 110 is clamped inside the cutting and clamping device 104 and the cutting end 107 of the lead-in cutting device 106 is moved away from the needle cylinders 102 and 103 (FIG. 10).

At the beginning of a knitting process, the thread guide 101 is moved into the active position, i.e., so that its end 114 is closer to the needle cylinders 102 and 103 and is arranged proximate to the needle work area, so as to allow the thread 110 to be taken up by the needles 111 that are made to knit at the feed being considered, while the end of the thread 110 remains clamped in the cutting and clamping device 104, as shown in FIG. 11.

At this point, or even before bringing the thread guide 101 into the active position, the chambers 121 and 124 are supplied with pressurized fluid, causing the cutting end 107 to move toward the needle cylinders 102 and 103, placing the cutting end 107 between the point where the thread 110 is clamped in the cutting and clamping device 104 and the end 114 of the thread guide 101, in the active position, or between the cutting and clamping device 104 and the needle cylinders 102 and 103.

Figure 12:
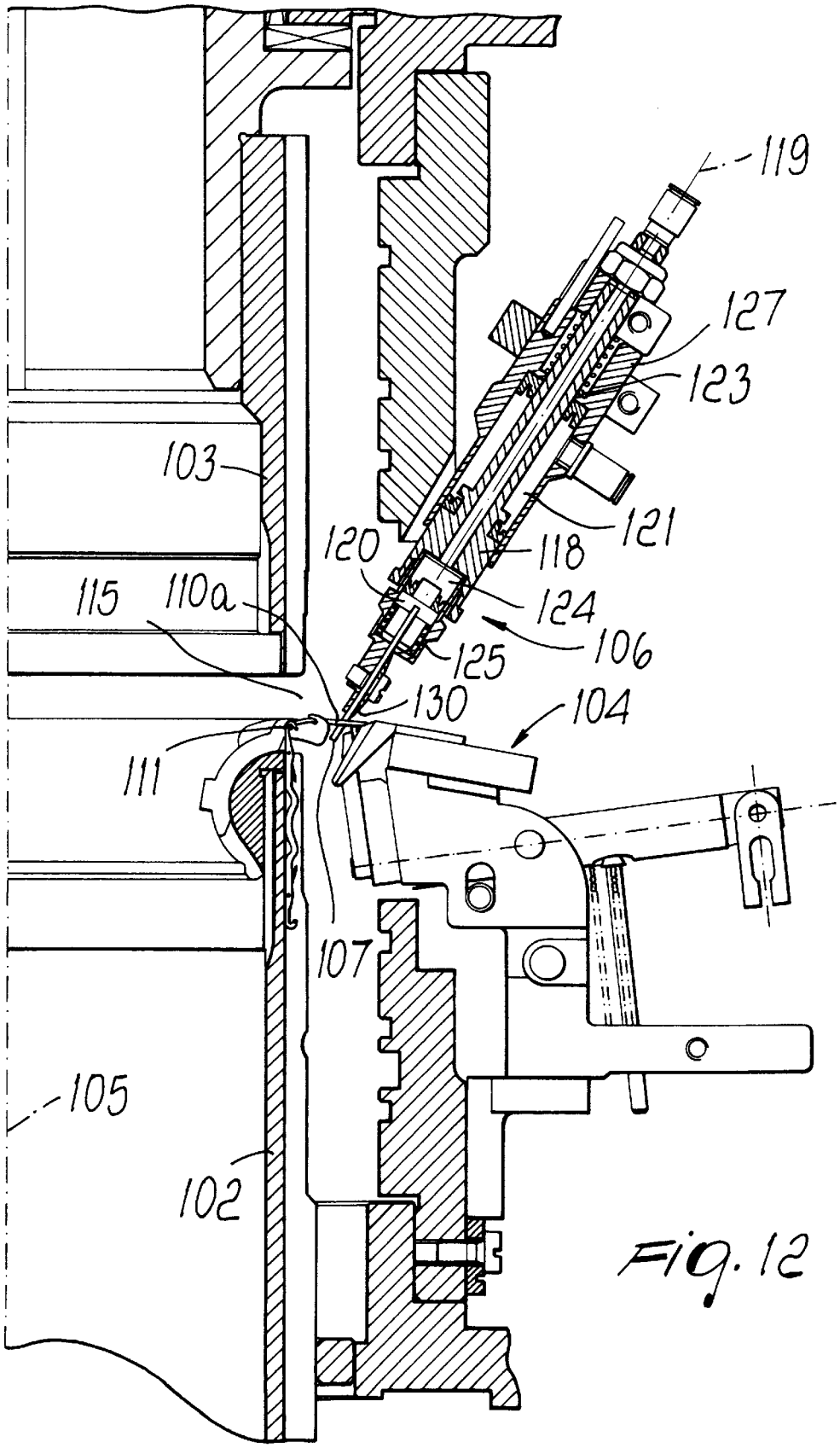

The needles 111 raised to knit at the feed being considered engage the thread 110 and start, in a per se known manner, to form loops of knitting, while the needle cylinders 102 and 103 rotate about their own axis 105 with respect to the thread guide 101, to the cutting and clamping device 104 and to the lead-in cutting device 106. This rotation causes the first needle 111 that took up the thread 110 to move toward the cutting and clamping device 104. This approach also causes the portion of thread 110*a* that lies between the first needle 111 that took up the thread and the cutting and clamping device 104 to engage the cutting end 107 of the lead-in cutting device 106, as shown in FIG. 12.

Figure 13:
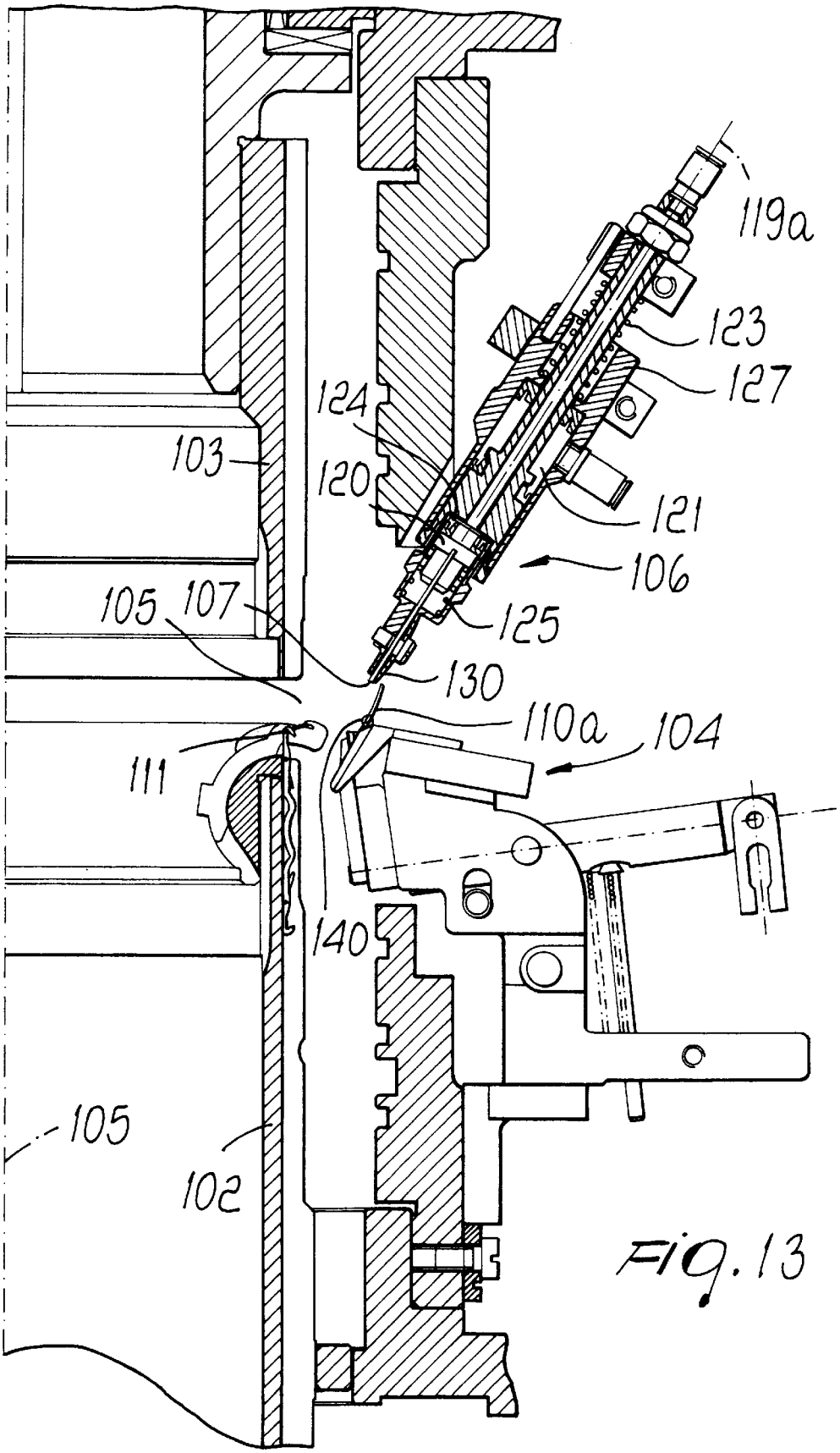

When the first needle 111 is adjacent to the cutting end 107, the chamber 124 is connected to the discharge, causing the movement of the cutting end 107, whereto the portion of thread 110*a* is engaged, away from the needle cylinders 102 and 103, consequently cutting said portion of thread 110*a* adjacent to the first needle 111 that took up the thread, by virtue of the action of the blade 130, as shown in FIG. 13. Due to the fact that the portion of thread 110*a* is cut adjacent to the first needle 111 that took up the thread 110, the length of the initial lead-in thread is minimized, eliminating the need for a subsequent step for cutting said lead-in thread.

The chamber 121 is then also connected to the discharge, causing a consequent movement of the fluid-driven cylinder 118 along the axis 119 away from the needle cylinders 102 and 103.

Figure 14:
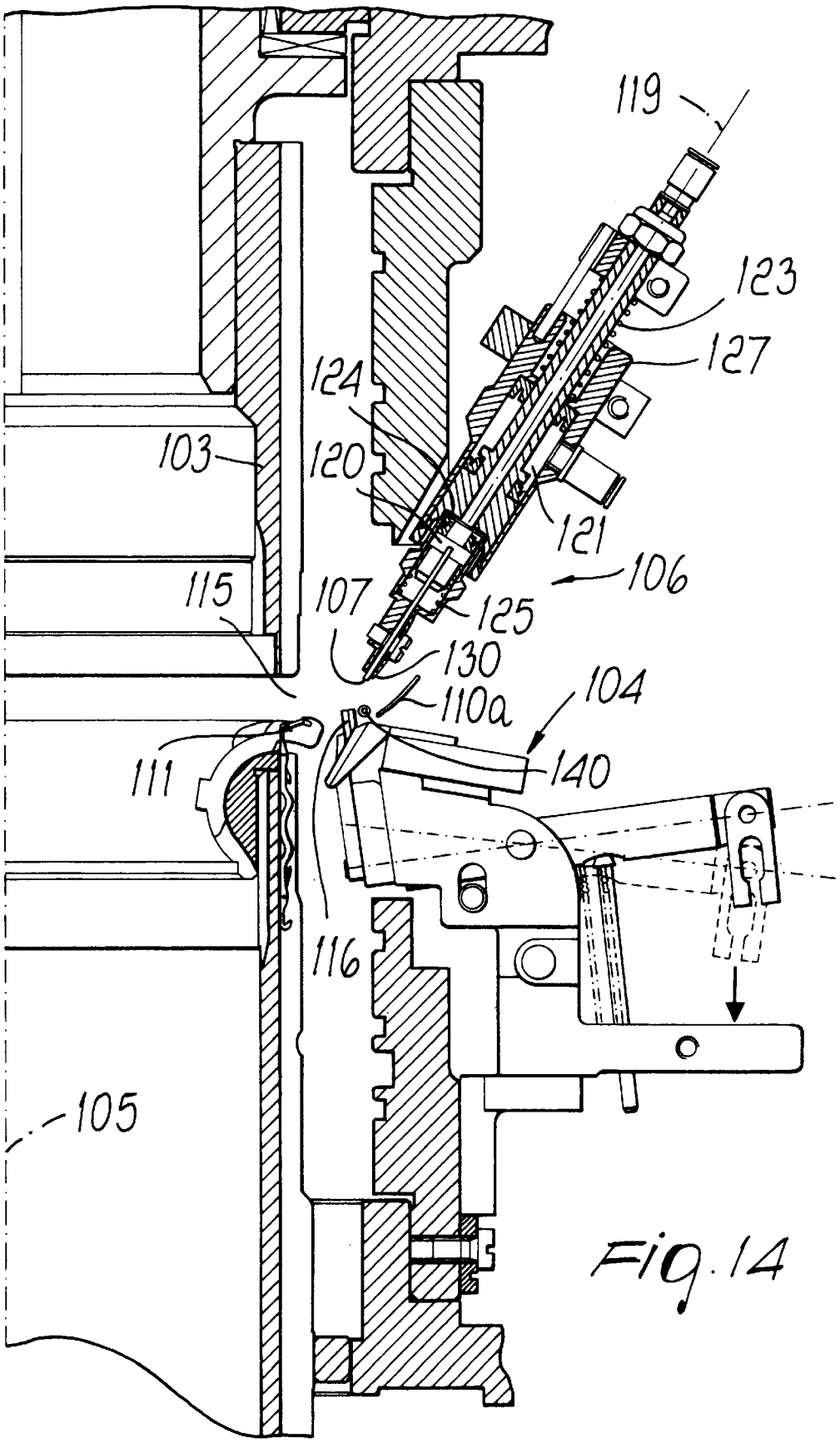

Finally, the cutting and clamping device 104 is actuated, lifting the hook 116 which releases the cut portion of thread 110*a,* and the nozzle 140 is actuated, moving the portion of thread 11*a* away to prevent it from being knitted in (FIG. 14).

In practice it has been observed that the process and the apparatus according to the invention fully achieve the intended aim, since cutting the lead-in thread of thread adjacent to the first needle that engages the thread avoids subsequent manual finishing of the item.

By eliminating this manual operation, the process and the apparatus according to the invention allow to reduce the overall manufacturing costs of the item.

The process and the apparatus thus conceived are susceptible of numerous modifications and variations, all of which are within the scope of the inventive concept; all the details may also be replaced with other technically equivalent elements.

In practice, the materials employed, as well as the dimensions, may be any according to requirements and to the state of the art.

The disclosures in Italian Patent Applications No. MI98A000529, MI98A001179, MI98A001235 from which this application claims priorities are incorporated herein by reference.

What is claimed is:

1. A process for reducing a length of a lead-in thread in a double-cylinder circular knitting machine having a corresponding thread guide for feeding the thread which is clamped at an end of said thread, before knitting begins, by a thread cutting and clamping device of said double-cylinder circular knitting machine which laterally faces needle cylinders of said double-cylinder circular knitting machine downstream of a position of said thread guide, relative to a direction in which the needle cylinders rotate about a common axis of said needle cylinders, with respect to said thread guide and to said thread cutting and clamping device, said process comprising:

moving a thread dispensing end of said thread guide toward the needle cylinders of said double-cylinder circular knitting machine to allow the thread to be taken up by needles that are moved so as to knit at a feed served by said thread guide;

keeping said end of the thread clamped by said thread cutting and clamping device, while the needles being lifted to knit, take up the thread and a first needle of said needles take up said thread;

moving a cutting end of a lead-in cutting device of said double-cylinder circular knitting machine toward the needle cylinders such that said lead-in cutting device being arranged proximate to said thread cutting and clamping device, so as to engage said cutting end with a portion of said thread that is arranged between said cutting and clamping device and said first needle of the needles that has taken up the thread;

cutting, by way of said cutting end of the lead-in cutting device, said portion of said thread that is adjacent to the first needle of said needles that has taken up the thread.

2. The process of claim 1, comprising arranging a plurality of needles located before the first needle that takes up the thread at the feed served by said thread guide, with an intermediate portion of the thread lying in a slot provided between the needle cylinders arranged as a lower needle cylinder and an upper needle cylinder, in order to form a barrier which is suitable to prevent the thread dispensed by said thread guide from passing into the needle cylinders before the thread is taken up by said first needle.

3. The process of claim 1, comprising: after the thread has been taken up by the needles that are made to knit, during rotation of the needle cylinders about the common axis which causes the first needle that took up the thread to move toward said lead-in cutting device, and before said portion of thread engages said cutting end of the lead-in cutting device, moving said thread cutting and clamping device so that a thread clamping point of said thread cutting and clamping device approaches said cutting end of the lead-in cutting device and is moved away from the needle cylinders in order to tension said portion of thread.

4. The process of claim 3, wherein during the rotation of the needle cylinders about the common axis, after said portion of thread has engaged said cutting end of the lead-in cutting device, said thread cutting and clamping device is moved so that the thread clamping point approaches said cutting end of the lead-in cutting device and is moved away from the needle cylinders in order to tension said portion of thread before said portion of the thread is cut by said lead-in cutting device.

5. The process of claim 4, wherein after said cutting end of the lead-in cutting device has moved toward the needle cylinders and before cutting said portion of thread, a thread portion that lies between the first needle that took up the thread and said cutting and clamping device is engaged by an upstream region of said cutting end of said lead-in cutting device, for tensioning said thread portion up to a region that lies downstream of said cutting end, so that said portion of thread arranged between said cutting and clamping device and the first needle of the needles that took up the thread engages said cutting end of the lead-in cutting device.

6. The process of claim 5, wherein engagement of the portion of thread that lies between the first needle that took up the thread and said cutting and clamping device is performed after said portion of thread has been tensioned following movement of said cutting and clamping device away from the needle cylinder.

7. An apparatus for reducing a length of the lead-in thread in a double-cylinder circular knitting machine having first and second needle cylinders rotatable about a common axis of said needle cylinders and provided with a plurality of needles; the apparatus comprising: a thread guide, which laterally faces the needle cylinders for dispensing the thread to the needles at a feed of the machine so that said needles take up the thread dispensed by said thread guide in a knitting process; a thread cutting and clamping device which laterally faces the needle cylinders and is arranged downstream of said thread guide in a direction in which the needle cylinders rotate with respect to said thread guide and to said cutting and clamping device; a lead-in cutting device which laterally faces the needle cylinders and is arranged proximate to said cutting and clamping device, said lead-in cutting device being provided with a cutting end which engages a portion of the thread that lies between said cutting and clamping device and a first needle of the needles that, at a beginning of the knitting process, took up thread dispensed by said thread guide, during rotation of the needle cylinders about the common axis with respect to said thread guide.

8. The apparatus of claim 7, wherein said cutting end of the lead-in cutting device is shaped as a hook which is open in an opposite direction with respect to a rotation direction of the needle cylinders relative to said lead-in cutting device, in order to receive said portion of said thread.

9. The apparatus of claim 7, wherein said cutting end of the lead-in cutting device is movable on command towards and away from the needle cylinders.

10. The apparatus of claim 9, wherein said cutting end of the lead-in cutting device is arranged downstream of a clamping point of the thread in said cutting and clamping device.

11. The apparatus of claim 10, wherein said cutting and clamping device is movable on command, with a thread clamping point of said cutting and clamping device, towards and away from the cutting end of said lead-in cutting device and toward and away from the needle cylinders so as to vary tension of said portion of said thread.

12. The apparatus of claim 11, wherein said cutting and clamping device is hinged to a supporting structure of said double-cylinder circular knitting machine, about a pivoting axis which is substantially parallel to the common axis of the needle cylinders, the apparatus further comprising actuation means acting on command on said cutting and clamping device for rotation of said cutting and clamping device about said pivoting axis.

13. The apparatus of claim 11, comprising a cutting blade, and, in said cutting end of the lead-in cutting device, a passage for said cutting blade which can be actuated on command.

14. The apparatus of claim 13, wherein said cutting end of the lead-in cutting device comprises clamping means for clamping said portion of said thread upon cutting said portion of said thread by said cutting blade.

15. The apparatus of claim 14, comprising: a rigid plate acting as a contrast blade and, a flexible spring for clamping one end of said portion of said thread when said portion of said thread is cut, said contrast blade and said flexible spring delimiting said passage on a first and second side of said passage.

16. The apparatus of claim 15, comprising an engagement device which can be actuated on command in order to engage said portion of said thread that lies between said cutting and clamping device and the first needle of the needles that took up the thread and make said thread engage said cutting end of the lead-in cutting device.

17. The apparatus of claim 16, wherein said engagement device has a hook-like end which can move on command in a direction which is substantially tangent to said needle cylinders between said cutting and clamping device and said cutting end of the lead-in cutting device, in order to grip said portion of said thread upstream of said cutting end of the lead-in cutting device and convey said portion of said thread until said portion of said thread is located downstream of said cutting end, for engagement of said portion of said thread with said cutting end of the lead-in cutting device.

18. The apparatus of claim 17, wherein said cutting end of the lead-in cutting device is arranged directly upstream of a point where the thread is clamped in said thread cutting and clamping device, between a thread dispensing point of said thread guide and the thread clamping point in said cutting and clamping device, for engagement of said portion of said thread with said cutting end as a consequence of a rotation of the needle cylinders about said common axis with respect to said lead-in cutting device.

19. The apparatus of claim 18, comprising a cutting blade for cutting said portion of said thread engaged by said cutting end, said cutting end of the lead-in cutting device being movable on command with respect to said cutting blade.

20. The apparatus of claim 19, wherein said lead-in cutting device comprises a first fluid-driven cylinder and a piston, said first fluid-driven cylinder being connected to said cutting end by way of said piston and being actuatable for moving said cutting end with respect to said blade.

21. The apparatus of claim 20, wherein said lead-in cutting device comprises a second fluid-driven cylinder which acts on said first fluid-driven cylinder to move the first fluid-driven cylinder toward and away from the needle cylinders.

22. The apparatus of claim 21, comprising removal means for removing said portion of said thread after cutting of said portion of said thread by said lead-in cutting device.

23. The apparatus of claim 22, wherein said removal means comprises a nozzle, said nozzle dispensing on command a jet of air toward said cutting end of the lead-in cutting device.

* * * * *